US008069619B1

(12) United States Patent
Inzeo

(10) Patent No.: US 8,069,619 B1
(45) **Date of Patent: *Dec. 6, 2011**

(54) VENTED GUTTER

(75) Inventor: Joseph A. Inzeo, West Allis, WI (US)

(73) Assignee: Metal-Era, Inc., Waukesha, WI (US)

( * ) Notice: Subject to any disclaimer, the term of this patent is extended or adjusted under 35 U.S.C. 154(b) by 427 days.

This patent is subject to a terminal disclaimer.

(21) Appl. No.: 12/393,079

(22) Filed: Feb. 26, 2009

Related U.S. Application Data

(63) Continuation-in-part of application No. 11/944,662, filed on Nov. 26, 2007, now Pat. No. 7,721,489.

(60) Provisional application No. 60/941,504, filed on Jun. 1, 2007.

(51) Int. Cl.
*E04D 13/00* (2006.01)

(52) U.S. Cl. ..... 52/95; 52/94; 52/302.3; 52/12; 248/48.2

(58) Field of Classification Search ..... 52/12, 94, 52/95, 96, 97, 302.3; 248/48.1, 48.2; 454/364, 454/365

See application file for complete search history.

(56) References Cited

U.S. PATENT DOCUMENTS

| | | | | |
|---|---|---|---|---|
| 2,954,727 | A | 9/1957 | Katt et al. | |
| 3,555,750 | A * | 1/1971 | Banse | 52/97 |
| 3,683,785 | A * | 8/1972 | Grange | 454/250 |
| 4,631,875 | A | 12/1986 | Olson | |
| 5,328,406 | A * | 7/1994 | Morris et al. | 454/260 |
| 5,927,023 | A * | 7/1999 | Kittilstad | 52/60 |
| 5,996,289 | A * | 12/1999 | Allaster | 52/95 |
| 6,932,901 | B2 | 8/2005 | Crosby | |
| 7,143,557 | B1 | 12/2006 | Ayers, Jr. | |

* cited by examiner

*Primary Examiner* — Robert Canfield
*Assistant Examiner* — Matthew Gitlin
(74) *Attorney, Agent, or Firm* — Donald J. Ersler

(57) ABSTRACT

A vented gutter system includes a gutter hanger and a ventilation strip. The gutter hanger preferably includes a lengthwise support, a plurality of hanger members and a plurality of mounting plates. Each hanger member includes a roof attachment leg and a fascia attachment member. Each mounting plate is attached to a single fascia attachment member. The plurality of mounting plates may be replaced with a single lengthwise mounting plate. The plurality of hanger members are attached to the lengthwise support. The ventilation strip is retained at a bottom of the plurality of hanger members. A vented fascia system preferably includes a rear plate, a roof flange, at least two bracket spacers, a fascia plate and a ventilation strip. The roof flange and rear plate are secured to the bracket spacers. The ventilation strip and the fascia plate are also secured to the bracket spacers.

9 Claims, 8 Drawing Sheets

VENTED GUTTER

CROSS-REFERENCES TO RELATED APPLICATIONS

This is a continuation-in-part patent application taking priority from patent application Ser. No. 11/944,662, filed Nov. 26, 2007 now U.S. Pat. No. 7,721,489 issued on May 25, 2010, which takes priority from provisional application No. 60/941,504 filed on Jun. 1, 2007.

BACKGROUND OF THE INVENTION

1. Field of the Invention The present invention relates generally to venting systems and more specifically to vented gutter, which combines a gutter hanger with a ventilator.

2. Discussion of the Prior Art

U.S. Pat. No. 2,954,727 to Katt et al. discloses a roof ventilator. The Katt et al. patent provides a roof ventilating construction for use at the eaves, which provides necessary air inlet openings into the space between adjacent roof rafters and between the roof and insulation on the interior thereof to assure ventilation of the entire roof structure. U.S. Pat. No. 4,631,875 to Olson discloses a gutter assembly and method of installation. The Olson patent includes a gutter assembly with a leaf guard and soffit strip for attachment along a roof edge. Ventilation openings may be formed through the soffit strip to allow ventilation into a rafter area of a roof.

U.S. Pat. No. 6,932,901 to Crosby discloses a one piece eaves treatment combining rain gutter, leaf screen, drip edge, fascia and soffit vent. The Crosby patent includes a gutter system, which combines a leaf screen, rain gutter, drip edge and soffit vent into a unitary, molded plastic structure. The gutter system forms the fascia along roof eaves. U.S. Pat. No. 7,143,557 to Ayers, Jr. discloses a structural vent assembly for a roof perimeter. The Ayers Jr. patent includes a structural vent assembly having a back member; a mount member adapted to be secured to a support structure; a front member; and means for attaching the front member to the back and mounting members in a spaced apart relationship.

Accordingly, there is a clearly felt need in the art for a vented gutter, which combines a gutter hanger with a ventilator that may be customized for each application.

SUMMARY OF THE INVENTION

The present invention provides a vented gutter, which either combines a gutter hanger with a ventilator or locates a ventilator behind a fascia. A vented gutter includes a gutter hanger and a ventilation strip. The gutter hanger preferably includes a lengthwise support, a plurality of hanger members and a plurality of mounting plates. The lengthwise support preferably includes an L-shaped cross section. Each hanger member includes a roof attachment leg, a gutter support leg and a fascia attachment member. Each mounting plate is attached to an end of a single fascia attachment member with any suitable process. In a second embodiment, the plurality of mounting plates are replaced with a single lengthwise mounting plate. The ventilation strip preferably includes a U-shaped cross section. A plurality of perforations are formed through the ventilation strip to allow the flow of air.

The plurality of hangers are attached to the lengthwise support with any suitable method. The ventilation strip is preferably secured to a bottom of the plurality of hanger members with a plurality of fasteners. The vented gutter hanging system is secured to a roof by inserting a plurality of fasteners through the plurality of roof attachment legs into a roof and inserting a plurality of fasteners through the plurality of mounting plates or the lengthwise mounting plate into a fascia board. A gutter is attached to the plurality of gutter support legs and the lengthwise support with a plurality of fasteners. A drip edge is preferably laid over the plurality of roof attachment legs and hooked over an edge of the gutter. A plurality of fasteners are inserted through the drip edge into the roof.

A vented fascia system preferably includes a rear plate, a roof flange, at least two bracket spacers, a fascia plate and a ventilation strip. A fastening lip extends from a bottom edge of the rear plate. The roof flange includes a roof attachment leg and a vertical leg extending downward from an end of the roof attachment leg. Each bracket spacer includes a rear mounting leg, a front mounting leg and a middle leg. The rear mounting leg extends from one end of the middle leg and the front mounting leg extends from the other end of the middle leg in a direction opposite that of the rear mounting leg. A snap clip extends from a bottom of the fascia plate to retain a snap flange extending from an end of the ventilation strip.

An open ended roof truss will require the attachment of an angle to provide an attachment surface. The rear plate and the rear mounting legs of the at least two bracket spacers are attached to an end of a roof truss or to the angle with a plurality of fasteners. The roof attachment leg of the roof flange is attached to a roof sheathing with a plurality of fasteners. The vertical leg of the roof flange is attached to the front mounting legs of the at least two bracket spacers with a plurality of fasteners. The ventilation strip is attached to the fastening lip with a plurality fasteners. The snap flange of the ventilation strip is retained in the snap clip of the fascia plate. The fascia plate is secured to the vertical leg and the front mounting legs of the at least two bracket spacers with a plurality of fasteners.

Accordingly, it is an object of the present invention to provide a vented gutter system, which combines a gutter hanger and a ventilator that may be adapted for each application.

Finally, it is another object of the present invention to provide a vented fascia system, which locates a ventilator behind a fascia.

These and additional objects, advantages, features and benefits of the present invention will become apparent from the following specification.

DETAILED DESCRIPTION OF THE PREFERRED EMBODIMENTS

Figure 1:
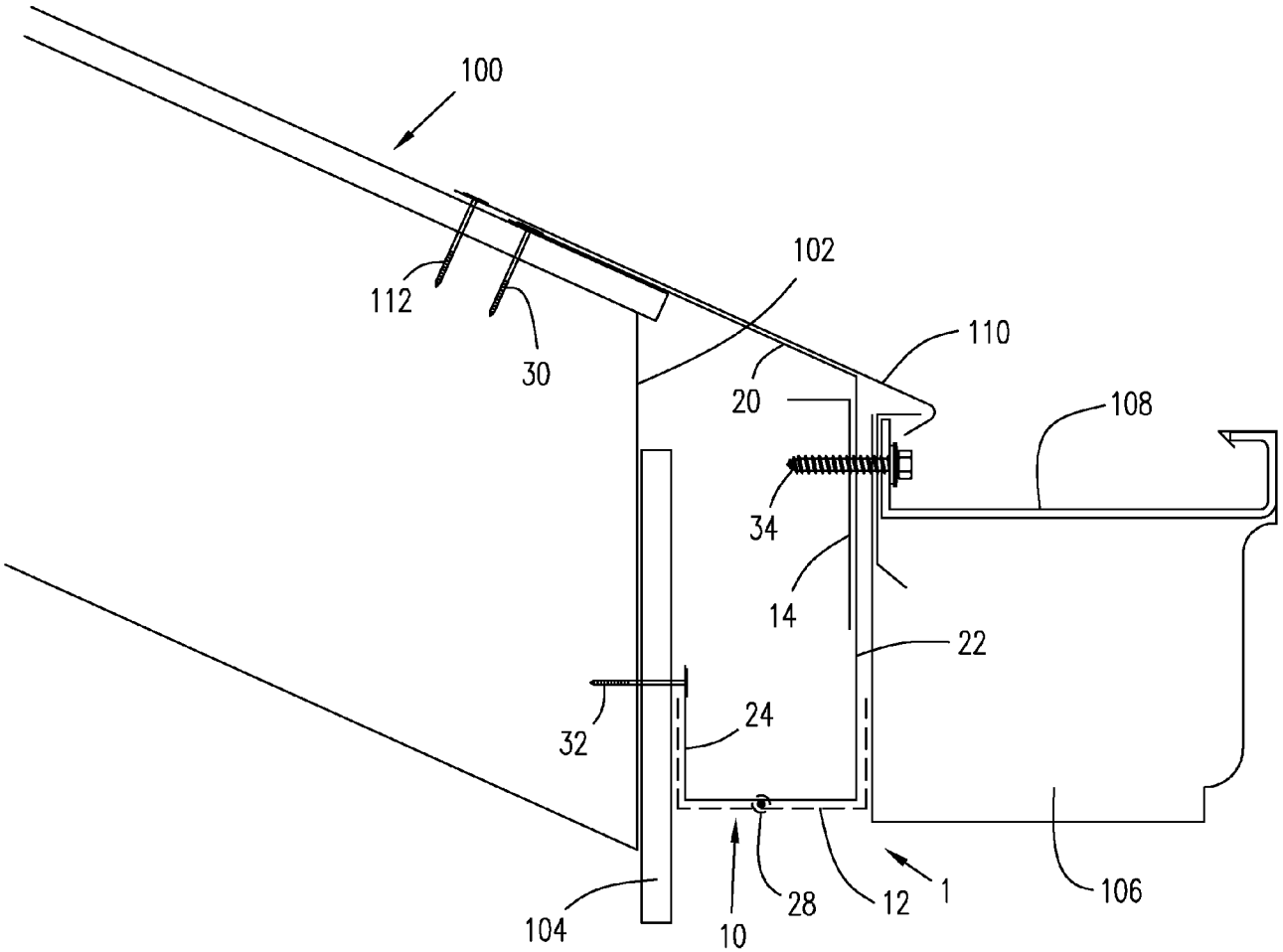
FIG. 1 is an end view of a vented gutter system with a gutter secured thereto and attached to a structure in accordance with the present invention.
Figure 2:
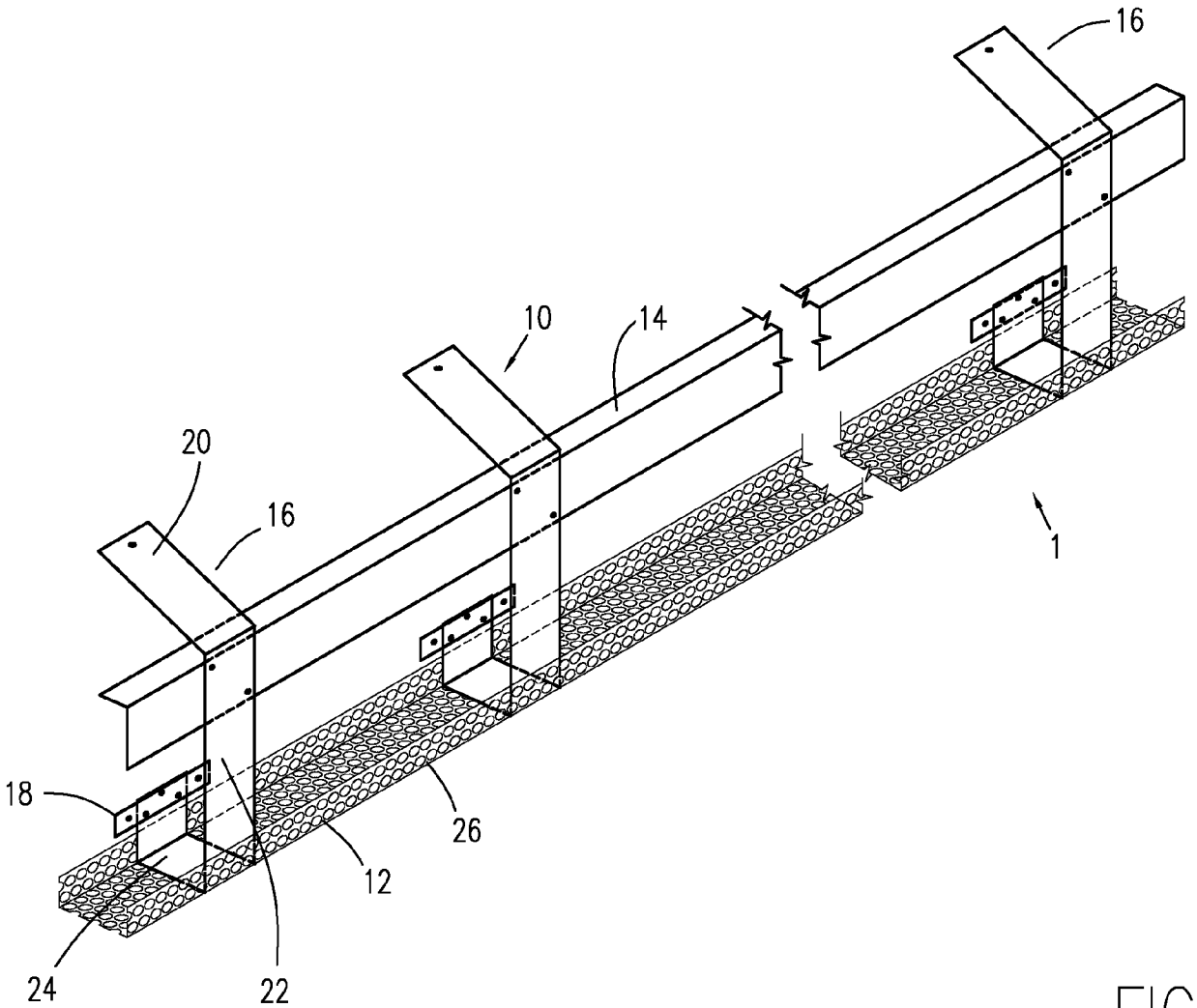
FIG. 2 is a perspective view of a vented gutter system in accordance with the present invention.

With reference now to the drawings, and particularly to FIG. 2, there is shown a perspective view of a vented gutter hanging system 1. With reference to FIG. 1, the vented gutter hanging system 1 includes a gutter hanger 10 and a ventilation strip 12. The gutter hanger 10 preferably includes a lengthwise support 14, a plurality of hanger members 16 and a plurality of mounting plates 18. The lengthwise support 14 preferably includes an L-shaped cross section for rigidity and strength.

Each hanger member 16 includes a roof attachment leg 20, a gutter support leg 22 and a fascia attachment member 24. The roof attachment leg 20 extends from one end of the gutter support leg 22 and a fascia attachment member 24 extends from the other end thereof. Each roof attachment leg 20 may be bent relative to the gutter support leg 22 at nearly any angle to accommodate different roof pitches. The fascia attachment member 24 has an L-shaped cross section. Each mounting plate 18 is attached to an end of the single fascia attachment member 24 with metal locking, welding or any other suitable process. The ventilation strip 12 preferably includes a U-shaped cross section, but other cross sectional shapes may also be used. A plurality of perforations 26 are formed through the ventilation strip 12 to allow the flow of air in to a roof vent opening 102 of a roof 100.

The plurality of hangers 16 are attached along a length of the lengthwise support 14 with metal locking, welding, a plurality of fasteners or any other suitable method. The ventilation strip 12 is preferably secured to a bottom of the plurality of fascia attachment members 24 with a plurality of fasteners 28. The vented gutter hanging system 1 is secured to the roof 100 by inserting a plurality of fasteners 30 through the plurality of roof attachment legs 20 into the roof 100 and inserting a plurality of fasteners 32 through the plurality of mounting plates 18 into a fascia board 104.

Figure 1A:
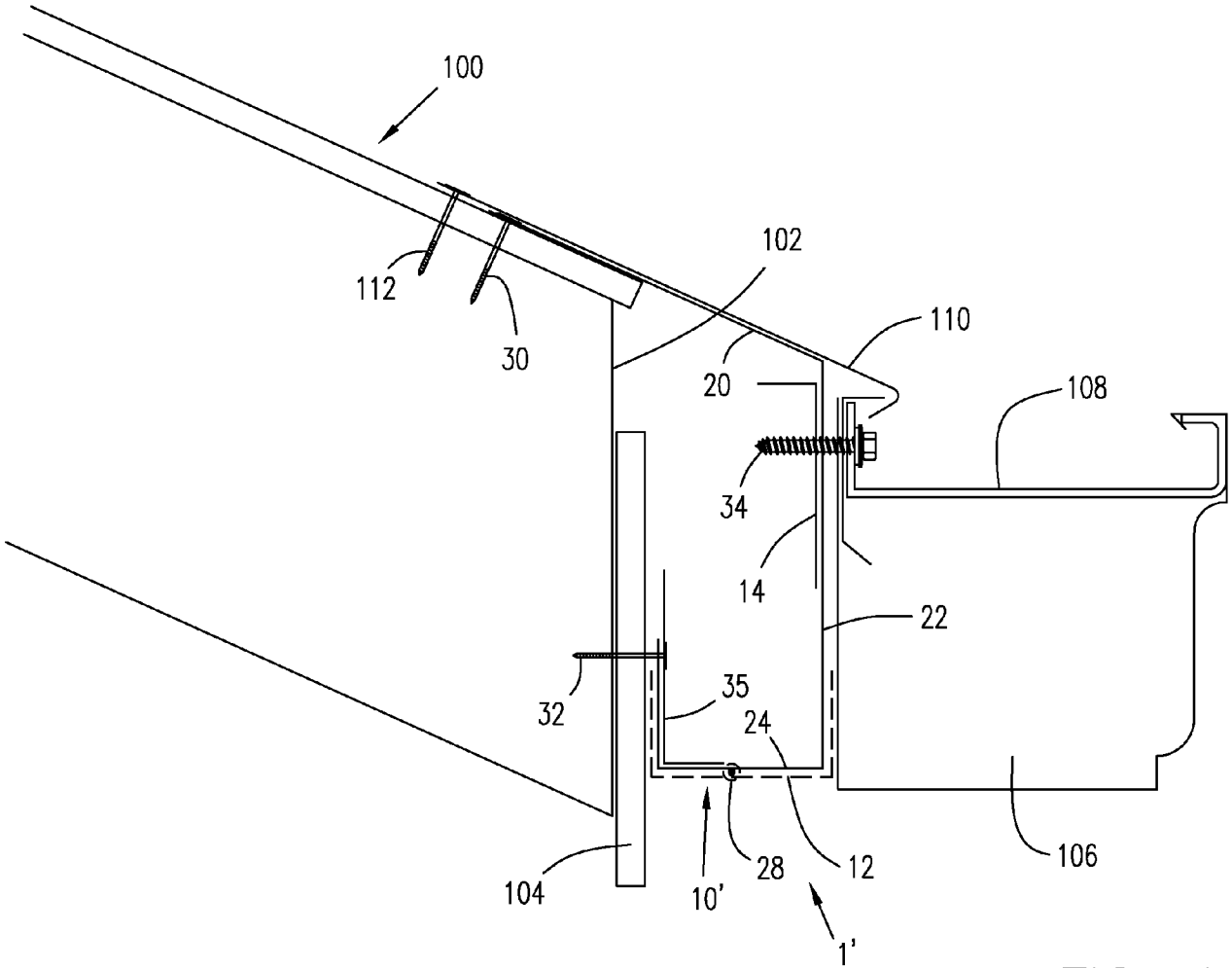
FIG. 1*a* is an end view of a second embodiment of a vented gutter system with a gutter secured thereto and attached to a structure in accordance with the present invention.
Figure 2A:
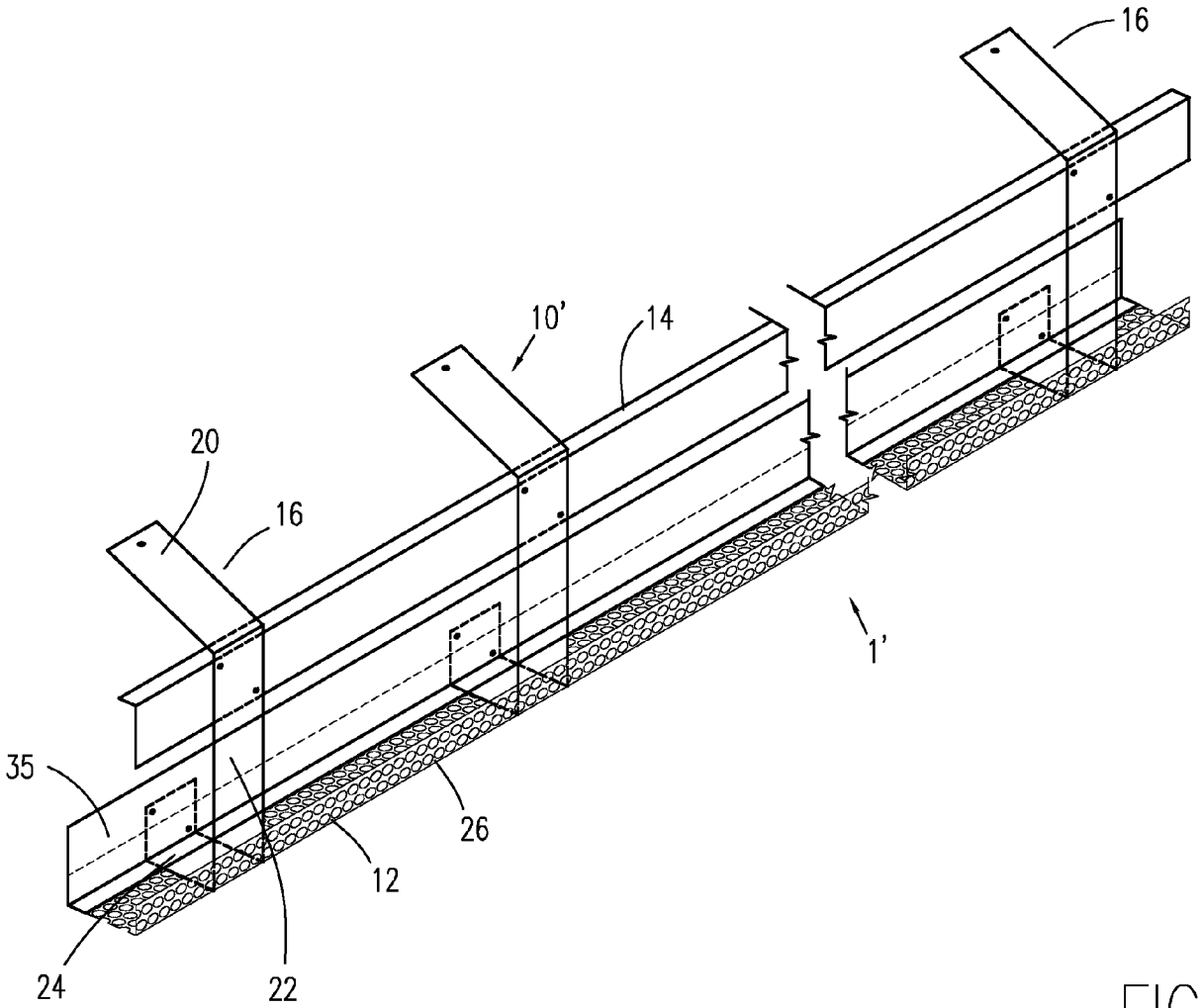
FIG. 2*a* is a perspective view of a second embodiment of a vented gutter system in accordance with the present invention.
Figure 3:
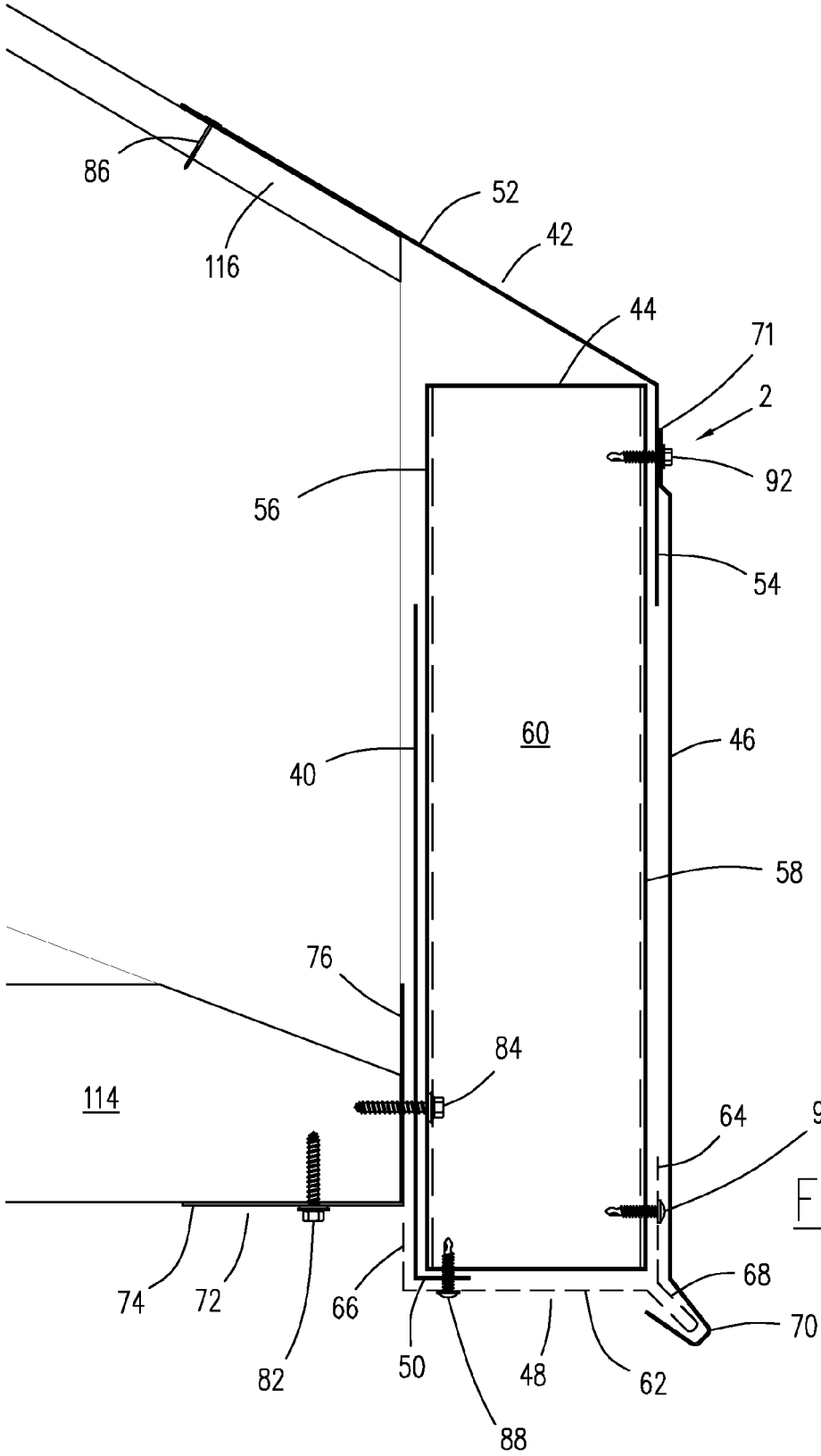
FIG. 3 is an end view of a vented fascia system attached to a structure in accordance with the present invention.
Figure 4:
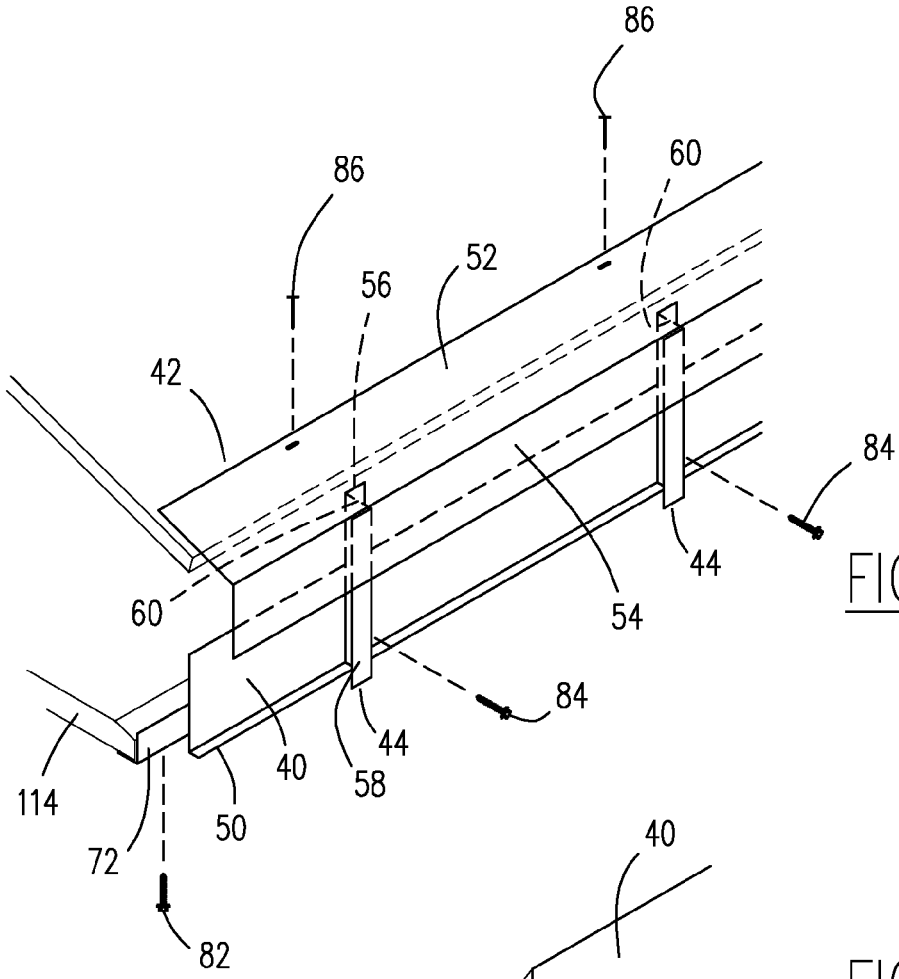
FIG. 4 is a perspective view of a partially assembled vented fascia system attached to a structure in accordance with the present invention.
Figure 5:
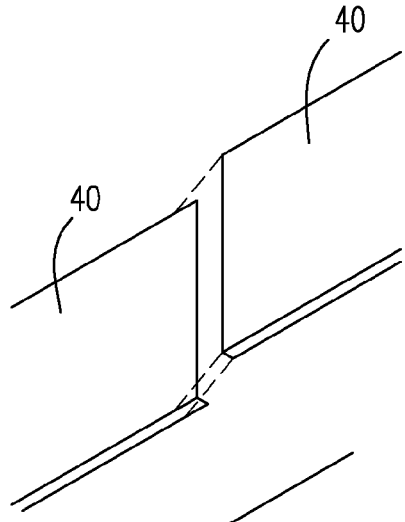
FIG. 5 is a perspective view of two adjacent rear plates of a vented fascia system in accordance with the present invention.

With reference to FIGS. 1*a* and 2*a*, a second embodiment of the vented gutter hanging system 1' includes a gutter hanger 10' and a ventilation strip 12. The gutter hanger 10' preferably includes the lengthwise support 14, the plurality of hanger members 16 and a lengthwise mounting plate 35. A single lengthwise mounting plate 35 replaces the plurality of mounting plates 18. The lengthwise mounting plate 35 is attached to the ends of the plurality of fascia attachment members 24 with metal locking, welding or any other suitable process. The lengthwise mounting plate 35 preferably includes an L-shaped cross section for rigidity and strength. The plurality of fasteners 32 are preferably inserted through the lengthwise mounting plate 35 into the fascia board 104.

A gutter 106 including a plurality of gutter straps 108 are attached to the gutter support leg 22 and the lengthwise support 14 with a plurality of fasteners 34. A drip edge 110 is laid over the plurality of roof attachment legs 20 and hooked over an edge of the gutter 106. A plurality of fasteners are inserted through the drip edge 112 into the roof 100.

The vented gutter hanging system 1, 1' may be sold with the plurality of hanger members 16 attached to the lengthwise support and the ventilation strip 12 attached to the plurality of hanger members 16. The vented gutter hanging system 1, 1' may also be sold without the assembly of hanger members 16, lengthwise support 14 and ventilation strip 12. In either case, the plurality of mounting plates 18 or lengthwise mounting plate 35 would be attached to the plurality of hanger members 16.

Figure 6:
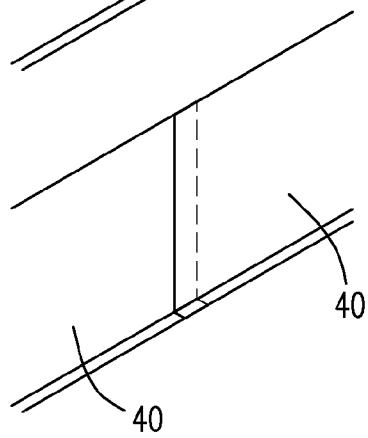
FIG. 6 is a perspective view of two rear plates overlapping each other of a vented fascia system in accordance with the present invention.

With reference to FIGS. 3-8, a vented fascia system 2 preferably includes a rear plate 40, a roof flange 42, at least two bracket spacers 44, a fascia plate 46 and a ventilation strip 48. A fastening lip 50 extends from a bottom edge of the rear plate 40. Two adjacent rear plates 40 are preferably overlapped as shown in FIG. 6 when installed on a structure. The roof flange 42 includes a roof attachment leg 52 and a vertical leg 54 extending downward from an end of the roof attachment leg 52. Each bracket spacer 44 includes a rear mounting leg 56, a front mounting leg 58 and a middle leg 60. The rear mounting leg 56 preferably extends substantially perpendicular from one end of the middle leg 60 and the front mounting leg 58 extends preferably substantially perpendicular from the other end of the middle leg 60 in a direction opposite that of the rear mounting leg 56.

A plurality of perforations 55 are formed through the ventilation strip 48 to allow the flow of air. The ventilation strip 48 includes a vent base 62, a front flange 64, a rear flange 66 and a snap flange 68. The front flange 64 extends upward from a front end of the vent base 62 and the rear flange 66 extends upward from a rear end of the vent base 62. The snap flange 64 extends outward from a junction of the front flange 64 and the vent base 62. A snap clip 70 is formed on a bottom of the fascia plate 46 and an offset leg 71 is formed on a top of the fascia plate 46. The snap clip 70 is sized to receive the snap flange 68 of the ventilation strip 48.

Figure 9:
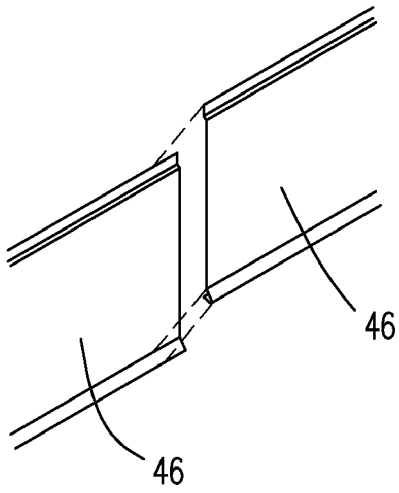
FIG. 9 is a perspective view of two adjacent fascia plates of a vented fascia system in accordance with the present invention.
Figure 10:
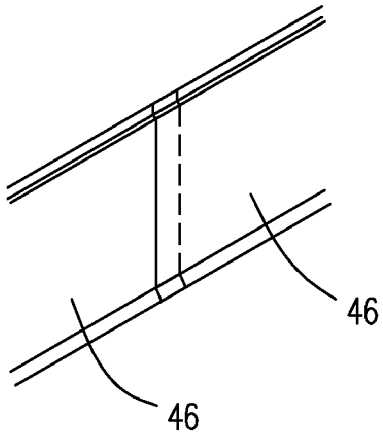
FIG. 10 is a perspective view of two fascia plates overlapping each other of a vented fascia system in accordance with the present invention.
Figure 11:
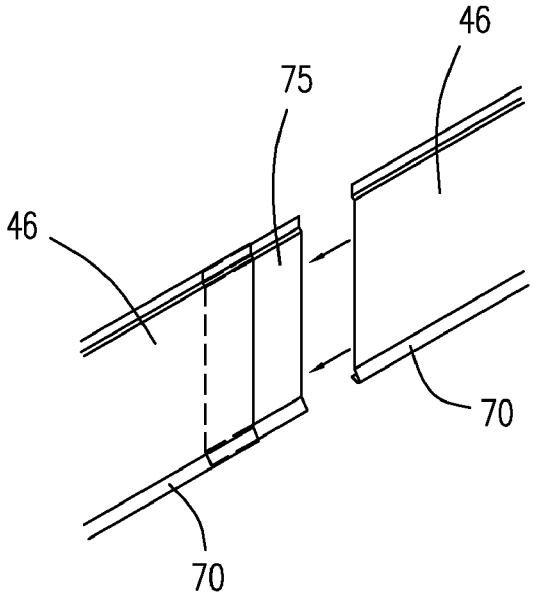
FIG. 11 is a perspective view of two fascia plates assembled to each other with a fascia splice of a vented fascia system in accordance with the present invention.

With reference to FIGS. 9-11, two adjacent fascia plates 46 may be overlapped or a fascia splice 75 may be used to join the two adjacent fascia plates 46. The fascia splice 75 includes substantially the same profile as the fascia plates 46. A bottom of the fascia splice 75 is inserted into the snap clip 70 and is sized to receive a rear of the fascia plates 46. An open ended roof truss 114 will require the attachment of an angle 72 to provide an attachment surface for the vented fascia system 2. The angle 72 includes a first leg 74 and a second leg 76, which extends from the first leg 74.

The vented fascia system 2 is preferably assembled to a structure in the following manner. If an open ended roof truss 114 is used, the angle 72 must be attached thereto. A plurality of first fasteners 82 are threaded through the first leg 74 and into a bottom of the open ended roof truss 114. The second leg 76 provides an attachment surface for a bottom of the rear plate 40 and the at least two brackets spacers 44. The rear plate 40 and the rear mounting legs 56 of the at least two bracket spacers 44 are attached to an end of the roof truss 114 or to the second leg 76 of the angle 72 with a plurality of fasteners 84. The roof attachment leg 52 of the roof flange 42 is attached to a roof sheathing 116 with a plurality of fasteners 86.

Figure 7:
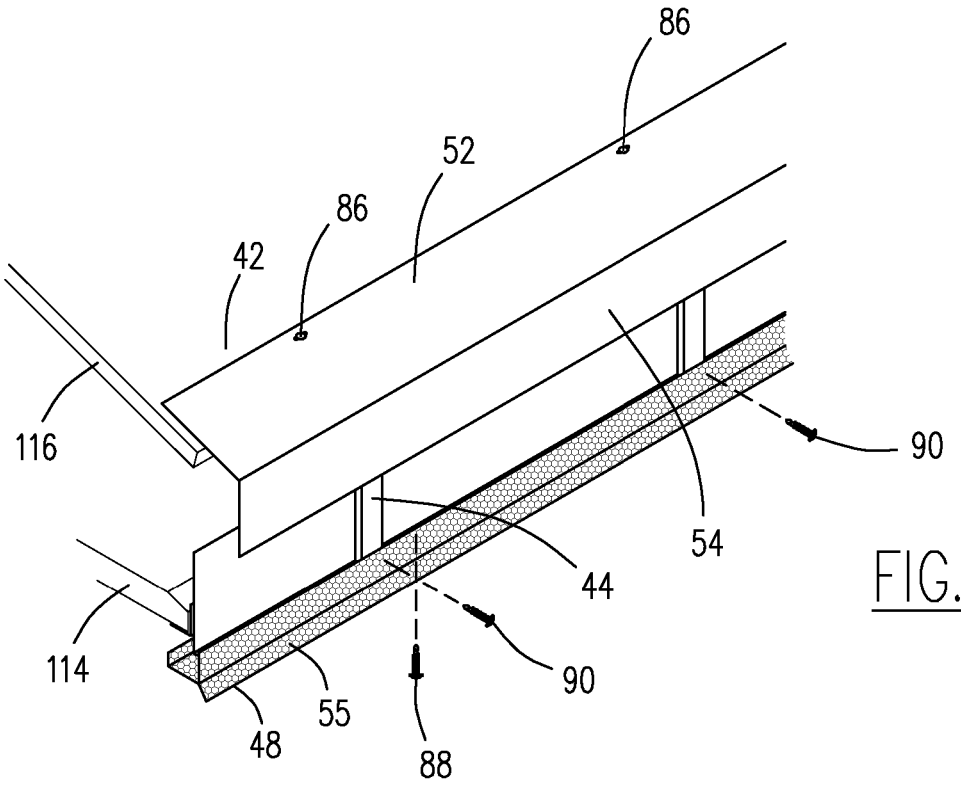
FIG. 7 is a perspective view of a partially assembled vented fascia system attached to a structure with the addition of a ventilation strip in accordance with the present invention.
Figure 8:
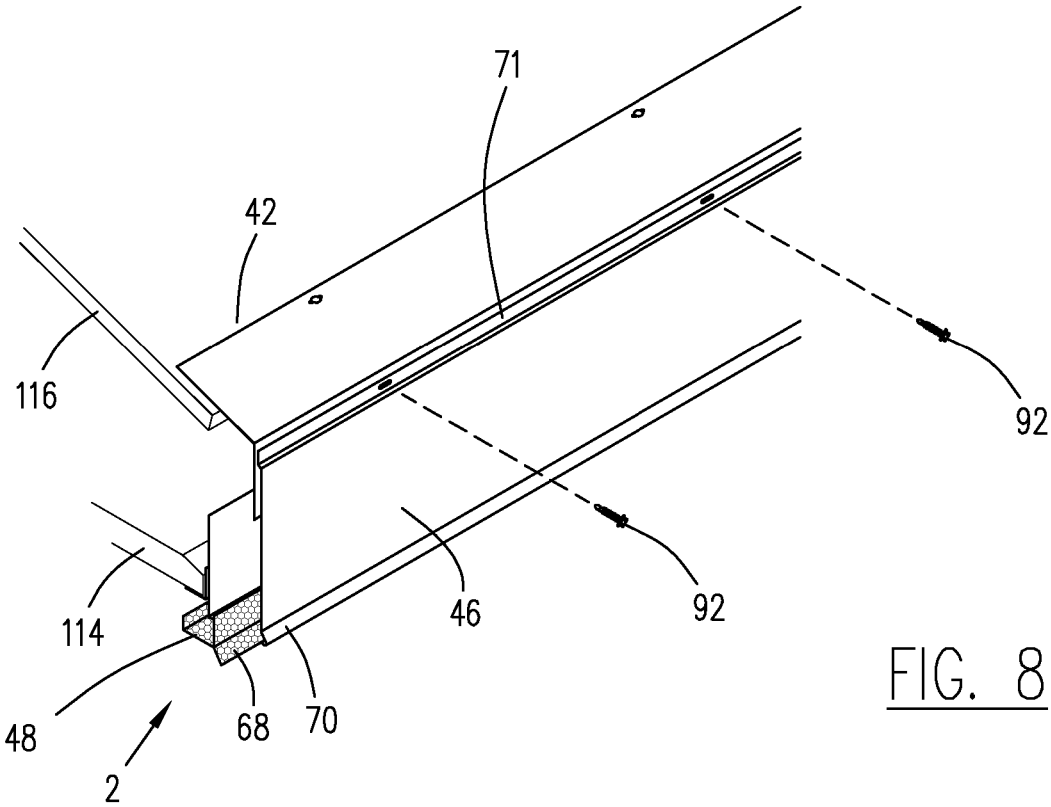
FIG. 8 is a perspective view of a vented fascia system attached to a structure in accordance with the present invention.

With reference to FIG. 7, the vent base 62 of the ventilation strip 48 is attached to the fastening lip 50 with a plurality of fasteners 88. The front flange 64 of the ventilation strip 48 is attached to the front mounting legs 58 with a plurality of fasteners 90. With reference to FIG. 8, the snap flange 68 of the ventilation strip 48 is inserted into the snap clip 70 of the fascia plate 46. The vertical leg 54 of the roof flange 42 and the offset leg 71 of the fascia plate 46 are attached to the front mounting legs 58 of the at least two bracket spacers 44 with a plurality of fasteners 92.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A venting system for an edge of a roof, comprising:

a lengthwise support;

a plurality of hanger members being attached along a length of said lengthwise support, at least one of said plurality of hanger members includes a roof attachment leg, a gutter support leg and a fascia attachment member, said roof attachment leg extends from one end of said gutter support leg and said fascia attachment member extends from the other end of said gutter support leg;

at least one mounting member being attached to a rear of said at least one fascia attachment member; and a ventilation strip being retained at a bottom of said at least one fascia attachment member.

2. The venting system for an edge of a roof of claim 1 wherein:

said mounting member being a lengthwise mounting plate.

3. The venting system for an edge of a roof of claim 1 wherein:

said mounting member being a plurality of mounting plates.

4. The vented gutter hanging system of claim 1, further comprising:

said ventilation strip having a U-shaped cross section and a plurality perforations formed therethrough.

5. The venting system for an edge of a roof of claim 1 wherein:

a gutter being attached to said lengthwise support.

6. A venting system for an edge of a roof, comprising:

a lengthwise support includes a L-shaped cross section;

a plurality of hanger members being attached along a length of said support plate, at least one of said plurality of hanger members includes a roof attachment leg, a gutter support leg and a fascia attachment member, said roof attachment leg extends from one end of said gutter support leg and said fascia attachment member extends from the other end of said gutter support leg;

at least one mounting member, each one of said at least one mounting member includes a L-shaped cross section, said at least one mounting member being attached to a rear of said at least one fascia attachment member; and a ventilation strip being retained at a bottom of said at least one fascia attachment member.

7. The vented gutter hanging system of claim 6, further comprising:

said ventilation strip having a U-shaped cross section and a plurality perforations formed therethrough.

8. The venting system for an edge of a roof of claim 6, further comprising:

a gutter being attached to said lengthwise support.

9. The venting system for an edge of a roof of claim 6, further comprising:

said roof attachment leg being bendable relative to said gutter support leg to accommodate different roof pitches.

* * * * *